US007409770B2

(12) United States Patent
Jones

(10) Patent No.: US 7,409,770 B2
(45) Date of Patent: Aug. 12, 2008

(54) BOW SIGHTING DEVICE

(76) Inventor: James A. Jones, 871 Lawrence Rd. 219, Black Rock, AR (US) 72415

( * ) Notice: Subject to any disclaimer, the term of this patent is extended or adjusted under 35 U.S.C. 154(b) by 0 days.

(21) Appl. No.: 11/484,405

(22) Filed: Jul. 11, 2006

(65) Prior Publication Data

US 2008/0010842 A1 Jan. 17, 2008

(51) Int. Cl.
*F41G 1/467* (2006.01)

(52) U.S. Cl. ..... 33/265; 124/87

(58) Field of Classification Search ..... 33/265, 33/DIG. 21; 124/87, 88
See application file for complete search history.

(56) References Cited

U.S. PATENT DOCUMENTS

| | | | | |
|---|---|---|---|---|
| 4,210,330 | A | 7/1980 | Kosbab | |
| 5,495,675 | A * | 3/1996 | Huang | 33/265 |
| 6,094,829 | A | 8/2000 | Koestler, III | |
| 6,134,793 | A | 10/2000 | Sauers | |
| 6,366,344 | B1 * | 4/2002 | Lach | 33/265 |
| 6,796,038 | B2 | 9/2004 | Humphries | |
| 7,040,030 | B2 * | 5/2006 | Sawaguchi | 33/DIG. 21 |
| 7,216,643 | B2 * | 5/2007 | Pellerite | 124/87 |
| 7,231,721 | B2 * | 6/2007 | Minica et al. | 33/265 |
| 7,255,035 | B2 * | 8/2007 | Mowers | 89/41.05 |
| 2005/0278964 | A1 * | 12/2005 | Minica et al. | 33/265 |

* cited by examiner

*Primary Examiner*—G. Bradley Bennett
(74) *Attorney, Agent, or Firm*—Dale J. Ream

(57) ABSTRACT

A bow sighting device according to the present invention includes a laser in electrical communication with a power source to actuate the laser to produce a laser beam. The bow sighting device includes an arrow shaft having forward and rear ends with the laser positioned in the arrow shaft such that the laser beam projects through the forward end. A focusing lens may be positioned at the forward end through which the laser beam passes. The sighting device may include a nock at the rear end and a pushrod configured such that the pushrod urges the power source into connection with the laser when the arrow shaft is placed in ready-to-fire configuration relative to the bow. The bow sighting device simplifies hunting with a compound bow or crossbow by providing a visual indication of exactly where the arrow shaft is aimed.

14 Claims, 7 Drawing Sheets

BOW SIGHTING DEVICE

BACKGROUND OF THE INVENTION

This invention relates generally to sighting devices and, more particularly, to a bow sighting device for focusing laser light on a target utilizing a laser mounted inside or outside of an arrow shaft.

In 2004, there were 14,283,920 deer hunters in the United States according to the Deer Hunter's Almanac. Of these, 3,183,643 were archery hunters. One reason that more deer hunters do not use compound bows may be the relative complexity of bow hunting equipment as compared to gun hunting equipment. Another reason most deer hunters prefer to use guns is that shots taken with bows often miss their targets, resulting in lost arrows or wounded (not killed) game. Sighting a compound bow during hunting or sighting a crossbow prior to an actual hunt can be a difficult endeavor.

Various devices have been proposed in the art for aiding a bow hunter in sighting or targeting a hunted animal. Sighting accessories may be mounted to the frame or strings of a compound bow for use by the hunter. Crossbows, and more particularly their targeting scopes, may also be "sighted in" by adjusting windage and elevation settings such that the hunter can achieve greater accuracy during a hunt although this is often a trial and error task. Once properly sighted, however, the hunter has confidence that he will hit whatever he is aiming at when he pulls the trigger. Although the prior devices and proposals are assumably effective for their intended purposes, the existing devices do not provide a virtually guaranteed means for targeting and hitting a deer or a sighting target.

Therefore, it would be desirable to have a sighting device that visually identifies exactly what an arrow is aimed at and where it will hit when released. Further, it would be desirable to have a bow sighting device that may be mounted directly in-line with the arrow shaft itself. In addition, it would be desirable to have a bow sighting device with visual identification means for use with compound bows or crossbows.

SUMMARY OF THE INVENTION

Accordingly, a bow sighting device according to the present invention includes a laser, a power source, and an arrow shaft. Various combinations of these components are possible and are described in detail below. Preferably, the laser is situated within the arrow shaft for producing a beam in a forward direction and linear with the arrow shaft. In other words, when the arrow shaft including the laser is placed in a compound bow or crossbow and is pulled back or cocked into firing position, the laser beam projecting from the arrow shaft indicates exactly where the arrow shaft will strike. This is useful during actual hunting or when sighting in the scope on a crossbow.

The power source electrically connected to the laser may be a battery that is also positioned inside the arrow shaft. Alternatively, the battery may be attached to the bow itself and connected to the laser through complementary electrical contacts on the bow and arrow shaft, respectively. In another alternative, the battery may be displaced from the laser but urged into contact therewith by a pushrod when the nock of the arrow shaft is positioned against a string of the bow in preparation for firing. In this position, the nock is compressed and urges the pushrod and battery into contact with the laser.

The sighting device may also include a focusing lens, reflector, or other optical devices positioned at the forward end of the arrow shaft and through which the laser beam passes. The focusing lens may focus the laser beam on a single point or may split the laser beam into more than one beam indicative of an appropriate shot selection depending on distance.

Therefore, a general object of the present invention is to provide a bow sighting device for providing an exact visual indication of where an arrow shaft is aimed.

Another object of the present invention is to provide a bow sighting device, as aforesaid, having a laser that may be mounted within an arrow shaft for producing a laser beam that extends forwardly in linear relationship to the shaft.

Still another object of the present invention is to provide a bow sighting device, as aforesaid, which may be powered by a battery mounted inside of the arrow shaft.

Yet another object of the present invention is to provide a bow sighting device, as aforesaid, which may focus the laser beam on a single point or split the beam into multiple beams.

A further object of the present invention is to provide a bow sighting device, as aforesaid, which may be facilitated by a laser powered by a battery, with either or both mounted to a bow frame.

A still further object of the present invention is to provide a bow sighting device, as aforesaid, that simplifies hunting with a compound bow, recurve bow, or crossbow.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
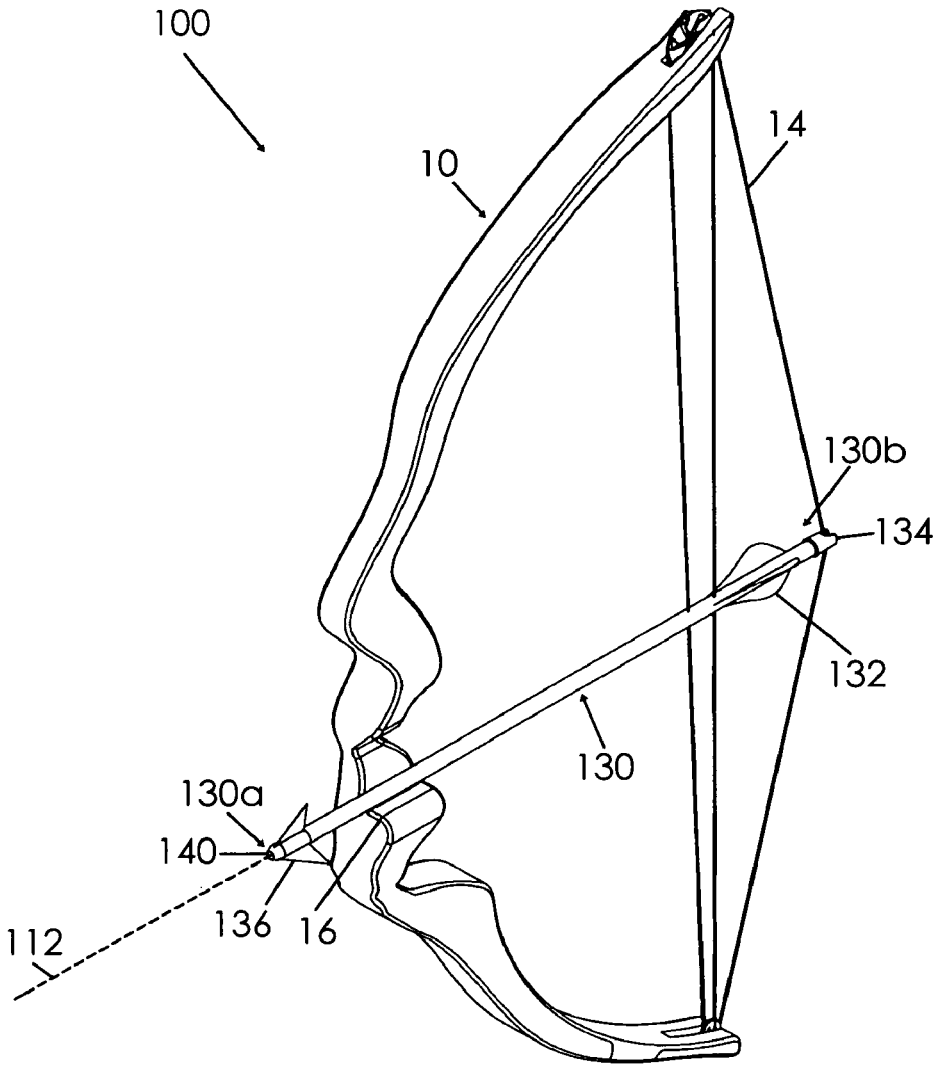
FIG. 1 is a perspective view of a bow sighting device according to a preferred embodiment of the present invention in use with a compound bow.

A bow sighting device 100 according to the present invention will now be described in detail with reference to FIGS. 1 through 2*b* and FIGS. 5 through 7 of the accompanying drawings. More particularly, a bow sighting device 100 according to the current invention includes a laser 110, a power source 120, and an arrow shaft 130.

Figure 7:
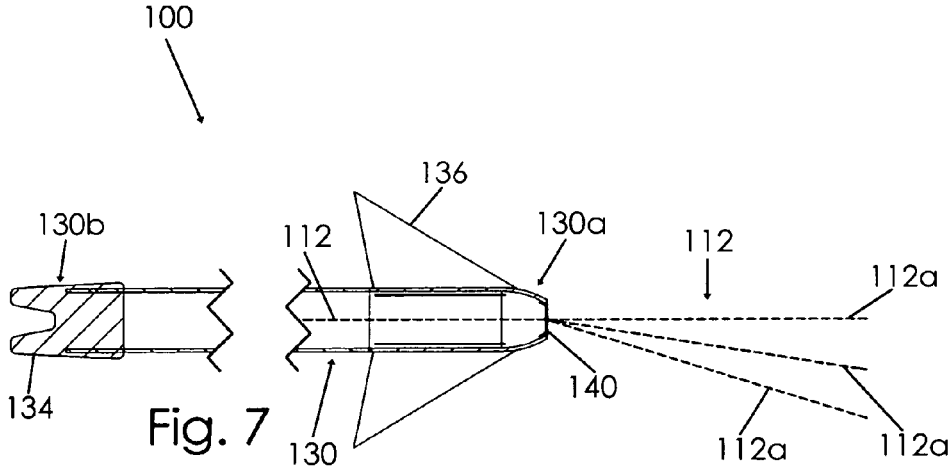
FIG. 7 is a segmented sectional view of FIG. 2*b* illustrating a split-beam focusing lens.

The laser 110 is in electrical communication with the power source 120 to actuate the laser 110. When actuated, the laser 110 produces a laser beam 112. The arrow shaft 130 has forward and rear ends 130*a*, 130*b*, and the laser beam 112 extends/projects from the shaft forward end 130*a* away from the shaft rear end 130*b* (FIG. 1). As best shown in FIG. 7, the laser beam 112 may extend from within the arrow shaft 130 through the shaft forward end 130*a*. The arrow shaft 130 may include fletching 132 at the shaft rear end 130*b*, a nock 134 at the shaft rear end 130*b*, and/or an arrowhead 136 at the shaft forward end 130*a* (FIG. 1).

It is understood that the arrowhead 136 may be removable (not shown), such as by a complementary threaded configuration. In such an embodiment, it is contemplated that a replacement arrowhead with laser may be re-attached to an arrow shaft if another one becomes damaged in use.

Figure 2A:
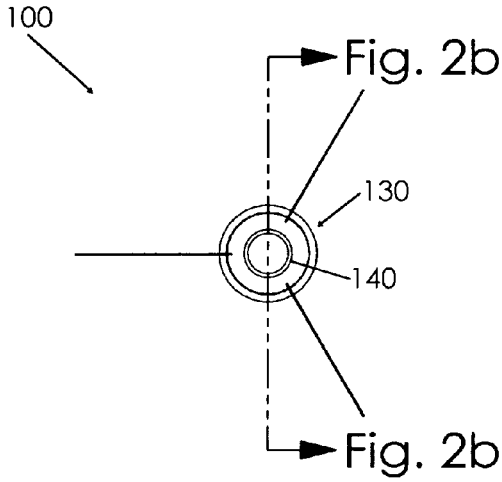
FIG. 2*a* is a front end view of an arrow shaft of the bow sighting device as in FIG. 1.
Figure 2B:
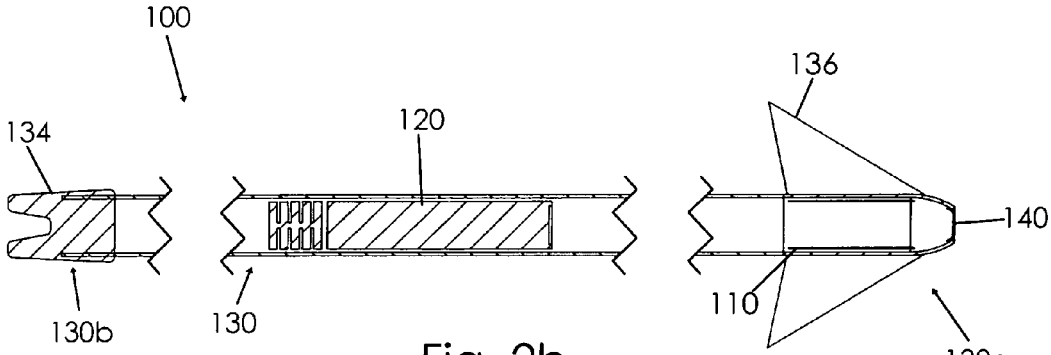
FIG. 2*b* is a sectional view taken along line 2*b*-2*b* of FIG. 2*a;*

As shown in FIGS. 1 through 2*b* and FIGS. 6*a* through 6*c*, the laser 110 may be coupled to the arrow shaft 130. Though it may be possible to couple the laser 110 to the outside of the arrow shaft 130, it is currently preferred to place the laser 110 inside the arrow shaft 130, as shown in FIG. 2*b*.

Figure 6A:
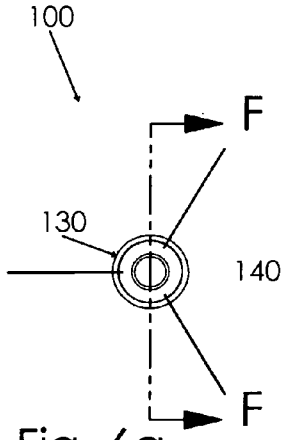
FIG. 6*a* is a front end view of an arrow shaft of the bow sighting device according to another embodiment of the present invention.
Figure 6B:
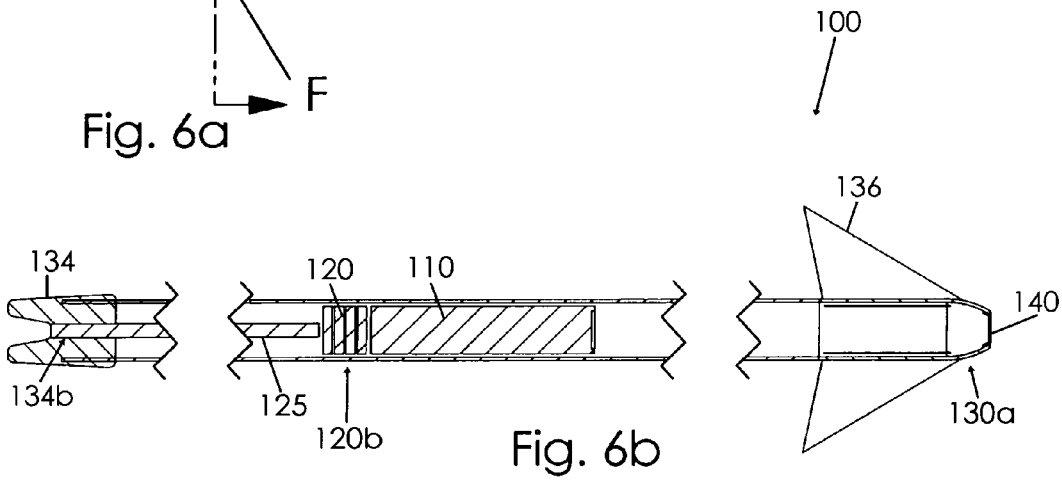
FIG. 6*b* is a sectional view taken along line 6*b*-6*b* of FIG. 6*a* with a nock in a compressed configuration urging a pushrod and battery into contact with a laser.
Figure 6C:
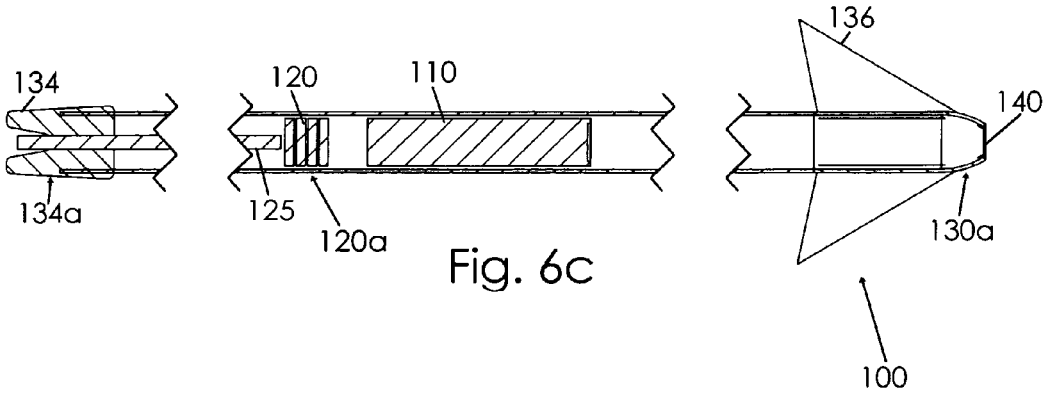
FIG. 6*c* is a sectional view as in FIG. 6*b* with the pushrod in an extended configuration.

FIGS. 1 through 2*b* and FIGS. 6*a* through 6*c* show that the power source 120 may be a battery 120 coupled to the arrow shaft 130. A pushrod 125 may extend from the nock 134 to the battery 120 to move the battery 120 from an inactivated configuration 120*a* when the pushrod 125 is at an extended configuration 134*a* (FIG. 6*c*) to an activated configuration 120*b* when the pushrod 125 is at a compressed configuration 134*b* (FIG. 6*b*). Other switches or actuators may alternately or additionally be used. Similarly, power sources other than a battery may also be used, such a solar cell array.

A focusing lens 140 may be positioned at the arrow shaft forward end 130*a*. As shown in FIG. 1, the focusing lens 140 may be configured to focus the laser beam 112 and direct the laser beam 112 in a direction linear with the arrow shaft 130 to accommodate gravity-induced arrow drop, wind deflection, or other perturbing effects. As shown in FIG. 7, the focusing lens 140 may be a splitting lens for splitting the laser beam 112 into a plurality of split laser beams 112*a*. Each split laser beam 112*a* may correspond to a predetermined distance as discussed further below. The optic devices utilized to manipulate the laser beam may alternatively include mirrors, reflectors, prisms, lenses, optical fibers or light pipes.

In use, the arrow shaft 130 may be coupled to a bow 10 in a conventional manner prior to its release. Specifically, the nock 134 may be aligned with a string 14 and the shaft forward end 130*a* may be placed at an arrow shelf 16. If a pushrod 125 is included, the string 14 may move the pushrod 125, and the pushrod 125 may in turn move the battery 120 to the activated configuration 120*b* as discussed above. The battery 120 may actuate the laser 110, which produces the laser beam 112. If the focusing lens 140 is configured to focus the laser beam 112 and direct the laser beam 112 in a direction linear with the arrow shaft 130 (as discussed above), the laser beam 112 may extend linearly from the arrow shaft 130 (FIG. 1). If the focusing lens 140 is a splitting lens (as discussed above), the split laser beams 112*a* may correspond to sighting of the bow at predetermined distances, each with a different gravity-induced drop in the arrow trajectory from a perfect line-of-sight parallel to the arrow shaft (FIG. 7). For example, one split laser beam 112*a* may correspond to a target thirty yards from the device 100, while another split laser beam 112 may correspond to a target forty yards from the device 100. The different split laser beams 112*a* compensate for the non-linear trajectory of the arrow shaft 130 over different distances when taking gravity into account. The arrow shaft 130 may be fired from the bow 10 using the laser beam 112 as a sight, or the laser beam 112 may be used to set physical sights on the bow 10.

Figure 3A:
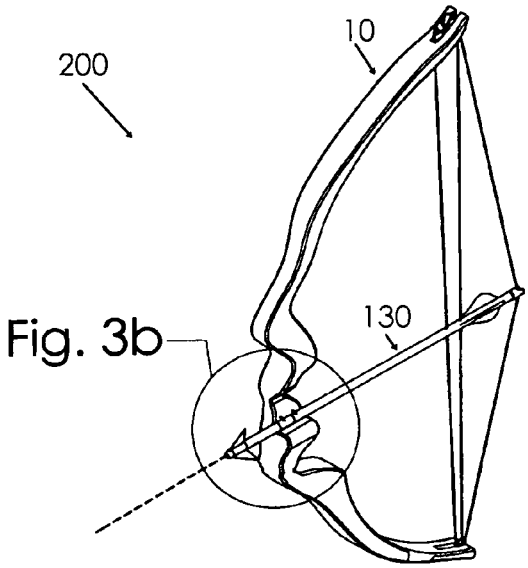
FIG. 3*a* is another perspective view of the bow sighting device as in FIG. 1.
Figure 3B:
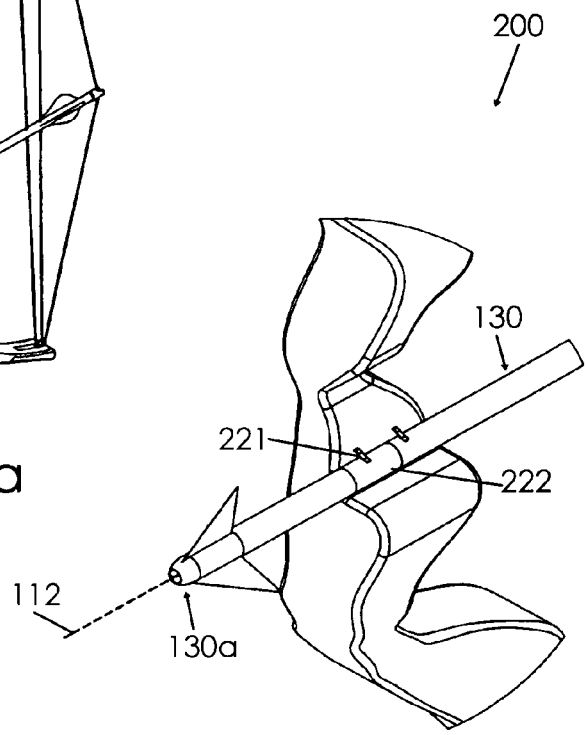
FIG. 3*b* is an isolated view of a portion of the bow sighting device as in FIG. 3*a;*
Figure 3C:
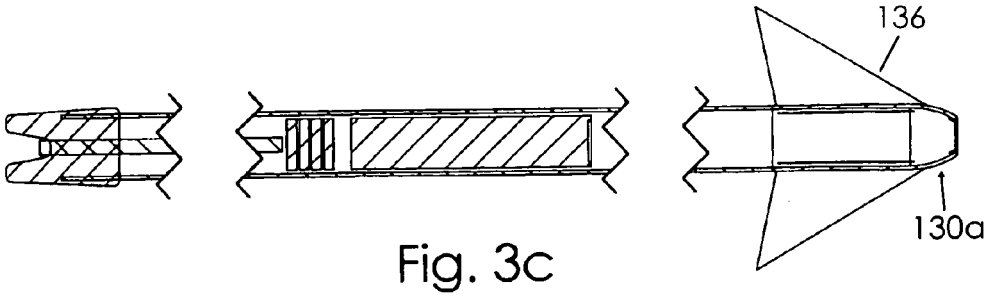
FIG. 3*c* is a sectional view of the arrow as in FIG. 3*a;*

A bow sighting device 200 according to another embodiment of the present invention is shown in FIGS. 3*a* and 3*b* and includes a construction substantially similar to the construction previously described except as specifically noted below. More particularly, the power source 120 may be a battery 120 coupled to the bow 10, and the bow sighting device 200 may include means for transferring energy from the battery 120 to the laser 110. In other words, the battery 120 is not positioned in the interior of the arrow shaft 130 in this embodiment. More particularly, a first electrical contact 221 may be coupled to the bow 10 and be in electrical communication with the battery 120; a second electrical contact 222 may be coupled to the arrow shaft 130 or a separate internal wire or conductor leading to the other post of the battery and be in electrical communication with the laser 110. The second electrical contact 222 may be in selective contact with the first electrical contact 221, such as when an arrow shaft 130 is positioned on the bow 10 prior to being shot, as best shown in FIG. 3*b*.

In use, the battery 120 may actuate the laser 110 only when the second electrical contact 222 is in contact with the first electrical contact 221. This embodiment may be advantageous over the first embodiment described above insofar as the arrow shaft 130 may be lighter since it does not house the power source 120.

Figure 4A:
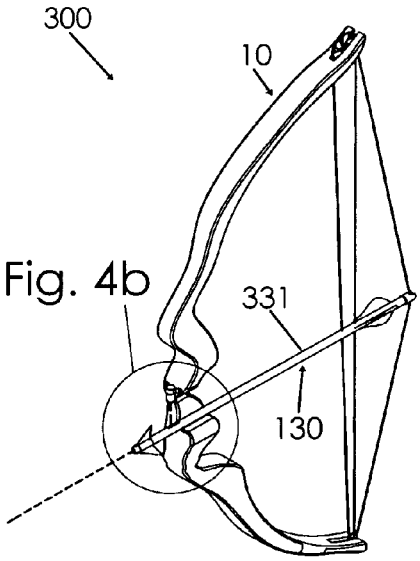
FIG. 4*a* is a perspective view of a bow sighting device according to another embodiment of the present invention.
Figure 4B:
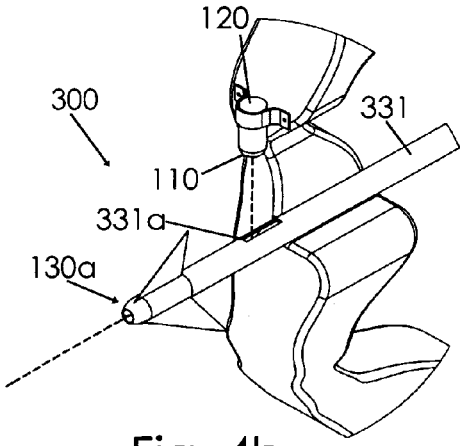
FIG. 4*b* is an isolated view of a portion of the bow sighting device as in FIG. 4*a;*
Figure 4C:
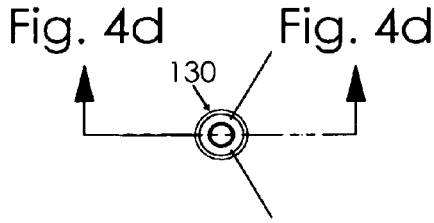
FIG. 4*c* is a front end view of an arrow shaft of the bow sighting device as in FIG. 4*a;*
Figure 4D:
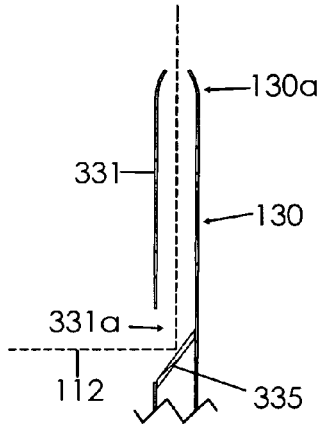
FIG. 4*d* is a sectional view taken along line 4*d*-4*d* as in FIG. 4*c;*
Figure 4D:
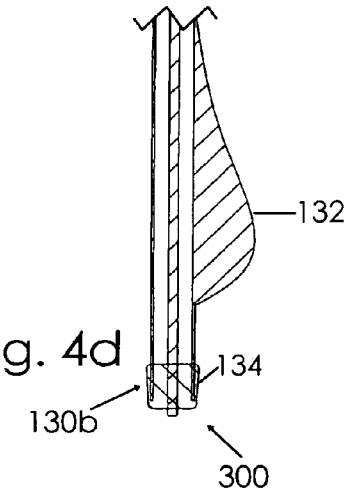

A bow sighting device 300 according to yet another embodiment of the present invention is shown in FIGS. 4*a* through 4*d* and includes a construction substantially similar to the construction previously described except as specifically noted below. More particularly, the laser 110 may be coupled to the bow 10 and the power source 120 may be coupled to the bow 10. The arrow shaft 130 may have a sidewall 331 that defines an opening 331*a*, as best shown in FIGS. 4*b* and 4*d*. Optics (e.g., mirror 335, a lens, and/or a fiberoptic cable) may be inside the arrow shaft 130 to direct the laser beam 120 from the sidewall opening 331*a* to the forward end 130*a* of the arrow shaft 130 (FIG. 4*d*).

In use, the battery 120 may actuate the laser 110, which produces the laser beam 112. The laser beam 112 may travel through the sidewall opening 331*a* (FIGS. 4*b* and 4*d*), and the optics (e.g., mirror 335) may direct the laser beam 120 from the sidewall opening 331*a* to the forward end 130*a* of the arrow shaft 130 (FIG. 4*d*). This embodiment may be advantageous over the first two embodiments described above insofar as the arrow shaft 130 may be lighter since it does not house the laser 110 or the power source 120.

Figure 5:
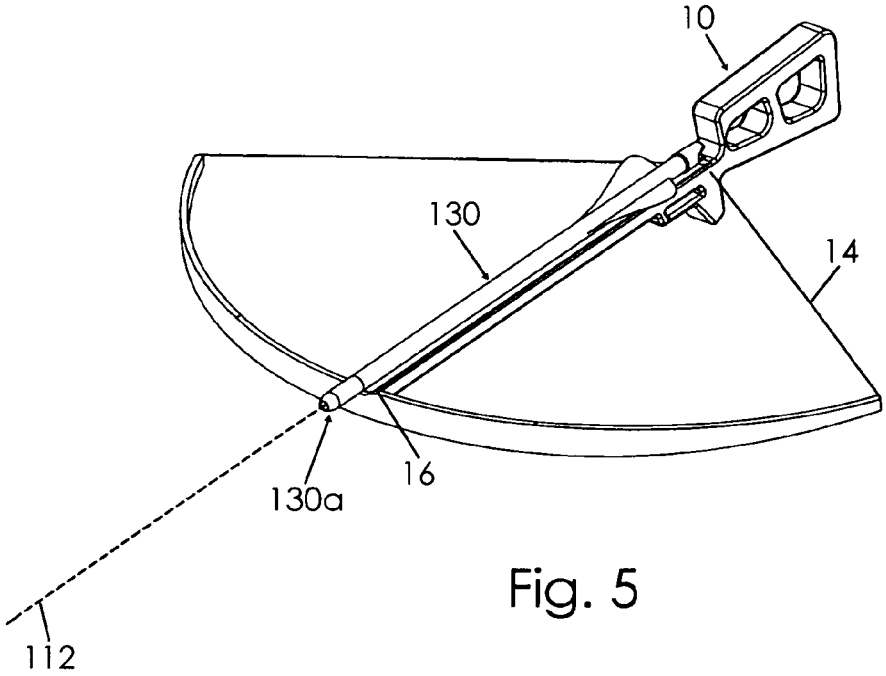
FIG. 5 is a perspective view of the bow sighting device as in FIG. 1 in use with a crossbow.

As shown in FIG. 5, it should be appreciated that the embodiment first described may be used successfully with a crossbow. Accordingly, the crossbow shown in FIG. 5 is also referred to with reference numeral 10 and includes a string 14 appropriate for coupling to the nock 134 of an arrow shaft 130. With laser turned on and aimed at a sighting target, the windage and elevation settings of a scope may be adjusted to coincide with the laser beam on the target. Then, during use, the cross-hairs of the scope may be trusted to be accurate for taking a shot.

While use of a laser in the present invention has been described throughout and is preferred, it is understood that other high intensity light emitting components may also be used, such as light emitting diodes (LEDs).

It is understood that while certain forms of this invention have been illustrated and described, it is not limited thereto except insofar as such limitations are included in the following claims and allowable functional equivalents thereof.

What is claimed is as follows:

1. A bow sighting device, comprising:

a laser in electrical communication with a power source to actuate said laser to produce a laser beam;

an arrow shaft having forward and rear ends, said laser beam projecting from said shaft forward end and away from said shaft rear end;

wherein:

said laser is coupled to a bow;

said power source is coupled to said bow;

said arrow shaft has a sidewall defining an opening; and optics are positioned inside said arrow shaft for directing said laser beam from said sidewall opening to said foward end of said arrow shaft wherein said power source is a battery;

a first electrical contact coupled to said bow and being in electrical communication with said battery; and a second electrical contact coupled to said arrow shaft and being in electrical communication with said laser, said second electrical contact being in selective contact with said first electrical contact.

2. The sighting device of claim 1, wherein said power source is a battery.

3. The sighting device of claim 2, further comprising:

fletching at said arrow shaft rear end;

a nock at said arrow shaft rear end; and an arrowhead at said arrow shaft forward end.

4. The sighting device of claim 1, further comprising a focusing lens at said arrow shaft forward end.

5. The sighting device of claim 1, wherein said optics include a mirror.

6. The sighting device of claim 1, further comprising a focusing lens at said arrow shaft forward end.

7. The sighting device of claim 6, wherein said focusing lens is a splitting lens for splitting said laser beam into a plurality of split laser beams, each said split laser beam corresponding to a predetermined sighting distance.

8. The sighting device of claim 6, wherein said focusing lens is configured to focus said laser beam and direct said laser beam in a direction linear with said arrow shaft.

9. The sighting device of claim 1, further comprising:

fletching at said arrow shaft rear end;

a nock at said arrow shaft rear end;

an arrowhead at said arrow shaft forward end; and a focusing lens at said arrow shaft forward end.

10. A bow sighting device, comprising:

a laser in electrical communication with a power source to actuate said laser to produce a laser beam;

an arrow shaft having forward and rear ends, said laser beam projecting from within said arrow shaft through said shaft forward end;

wherein:

said laser is coupled to a bow;

said power source is coupled to said bow;

said arrow shaft has a sidewall defining an opening;

optics are inside said arrow shaft to direct said laser beam from said sidewall opening to said forward end of said arrow shaft; and a focusing lens as at said arrow shaft forward end.

11. A sighting device for use with a bow, comprising:

a laser in electrical communication with a battery to actuate said laser to produce a laser beam;

an arrow shall having forward and rear ends, said laser beam projecting from said shaft forward end and away from said shaft rear end;

wherein said laser and said battery are attached to and situated in said arrow shaft;

a nook at said arrow shaft rear end, said nook being movable between extended and compressed configurations; and a pushrod extending from said nook toward said battery so as to move said battery from an inactivated configuration when said pushrod is at said extended configuration and an activated configuration when said pushrod is at said compressed configuration, said battery being in electrical communication with said laser at said activated configuration.

12. The sighting device as in claim 11 further comprising a focusing lens at said arrow shaft forward end.

13. The sighting device of claim 12, wherein said focusing lens is a splitting lens for splitting said laser beam into a plurality of split laser beams, each said split laser beam corresponding to a predetermined distance.

14. The sighting device as in claim 13, wherein said focusing lens is configured to focus said laser beam and direct said laser beam in a direction linear with said arrow shaft.

* * * * *